US008117874B2

(12) United States Patent
McKeown

(10) Patent No.: US 8,117,874 B2
(45) Date of Patent: Feb. 21, 2012

(54) THEFT DETERRENT DEVICE INCLUDING A SPRING WASHER

(75) Inventor: Thomas McKeown, Pennsauken, NJ (US)

(73) Assignee: Checkpoint Systems, Inc., Philadelphia, PA (US)

( * ) Notice: Subject to any disclaimer, the term of this patent is extended or adjusted under 35 U.S.C. 154(b) by 346 days.

(21) Appl. No.: 12/509,722

(22) Filed: Jul. 27, 2009

(65) Prior Publication Data

US 2010/0031711 A1 Feb. 11, 2010

Related U.S. Application Data

(60) Provisional application No. 61/086,952, filed on Aug. 7, 2008.

(51) Int. Cl.
*E05B 65/00* (2006.01)

(52) U.S. Cl. ..... 70/57.1; 340/572.1; 340/572.9; 24/704.1

(58) Field of Classification Search ..... 70/57.1; 340/572.1, 572.8, 572.9; 24/704.1
See application file for complete search history.

(56) References Cited

U.S. PATENT DOCUMENTS

| | | | | |
|---|---|---|---|---|
| 3,995,900 | A * | 12/1976 | Humble et al. | 70/57.1 |
| 4,156,302 | A * | 5/1979 | Van Niel | 24/707.5 |
| 4,221,025 | A * | 9/1980 | Martens et al. | 70/57.1 |
| 4,299,870 | A * | 11/1981 | Humble | 24/704.2 |
| 4,311,992 | A * | 1/1982 | DeChant | 340/572.9 |
| 4,502,717 | A * | 3/1985 | Close | 70/57.1 |
| 4,523,356 | A * | 6/1985 | Charlot, Jr. | 24/706.8 |
| 4,722,119 | A * | 2/1988 | Green | 70/57.1 |
| 4,944,075 | A * | 7/1990 | Hogan | 24/704.1 |
| 4,987,754 | A * | 1/1991 | Minasy et al. | 70/57.1 |
| 5,077,872 | A | 1/1992 | Guthammar | |
| 6,023,951 | A * | 2/2000 | Maurer et al. | 70/57.1 |
| 6,285,286 | B1 * | 9/2001 | Tyren et al. | 340/572.9 |
| 6,920,769 | B2 * | 7/2005 | Huehner | 70/57.1 |
| 7,190,272 | B2 * | 3/2007 | Yang et al. | 340/572.8 |

(Continued)

FOREIGN PATENT DOCUMENTS

DE 2656511 6/1978

(Continued)

OTHER PUBLICATIONS

International Search Report with respect to International Application No. PCT/US2009/052102.

*Primary Examiner* — Suzanne Barrett
(74) *Attorney, Agent, or Firm* — Caesar, Rivise, Bernstein, Cohen & Pokotilow, Ltd.

(57) ABSTRACT

A device to protect an article from theft is disclosed. The device includes a pointed pin member to enable attachment of the device to the article to be protected from theft. A housing disposed within the device includes a floor and a wall tapering towards a confining end. The housing includes coaxial openings for insertably receiving the pin member. A ball clutch mechanism is located within the housing and includes a plurality of balls. As the balls are urged towards the confining end of the housing, they wedge between the tapering wall and the pin member to apply increasing radial pressure against the pin member to prevent it from being withdrawn from the device. The floor includes a member which deflects downwardly upon insertion of the pin member into the housing to apply a radial force against the pin member to frictionally engage it within the device.

20 Claims, 5 Drawing Sheets

U.S. PATENT DOCUMENTS

| | | | | |
|---|---|---|---|---|
| 7,286,054 | B2 * | 10/2007 | Skjellerup et al. | 340/572.1 |
| 7,536,884 | B2 * | 5/2009 | Ho | 70/57.1 |
| 7,724,146 | B2 * | 5/2010 | Nguyen et al. | 340/572.8 |
| 7,750,806 | B1 * | 7/2010 | Skjellerup et al. | 340/568.1 |
| 2004/0040349 | A1 * | 3/2004 | Guttadauro et al. | 70/57.1 |
| 2006/0070410 | A1 * | 4/2006 | Fuss et al. | 70/57.1 |
| 2006/0070411 | A1 * | 4/2006 | Ho et al. | 70/57.1 |
| 2006/0174667 | A1 * | 8/2006 | Garner | 70/57.1 |
| 2007/0152836 | A1 * | 7/2007 | Nagelski et al. | 340/572.9 |
| 2007/0252707 | A1 | 11/2007 | Seidel | |

FOREIGN PATENT DOCUMENTS

| | | | |
|---|---|---|---|
| DE | 4417821 | A1 | 11/1995 |
| EP | 1505551 | A2 | 2/2005 |
| WO | WO9918312 | | 4/1999 |
| WO | WO2006089162 | A2 | 8/2006 |

* cited by examiner

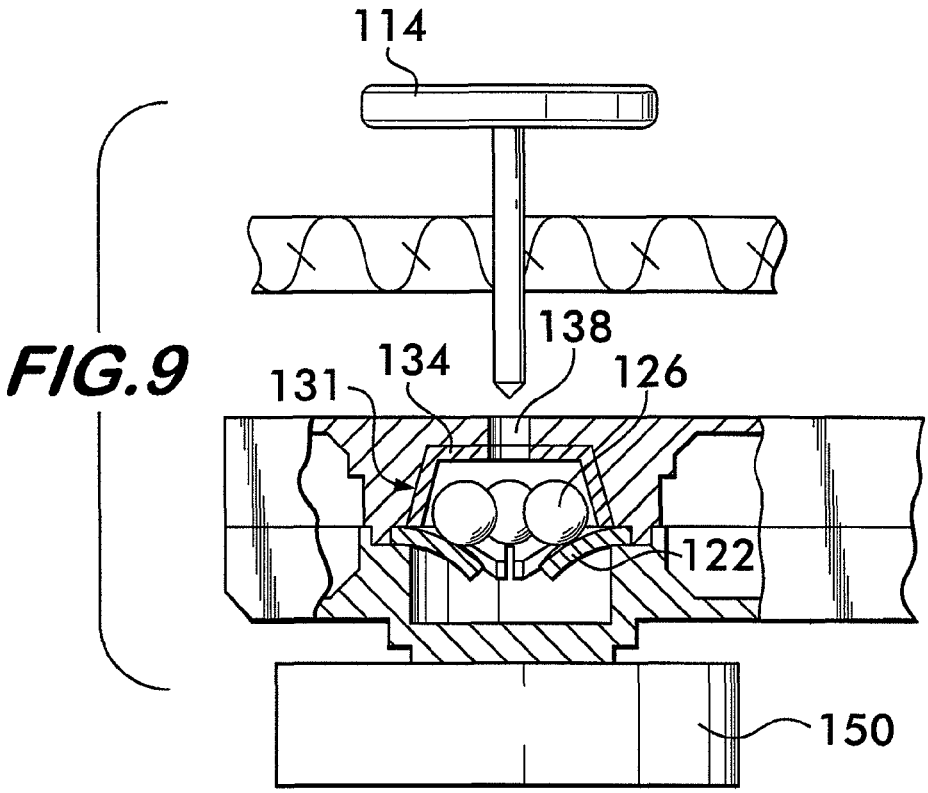
FIG.9
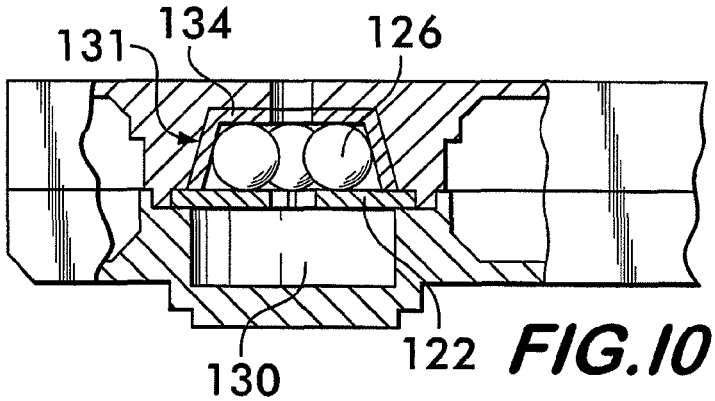
FIG.10
FIG.11
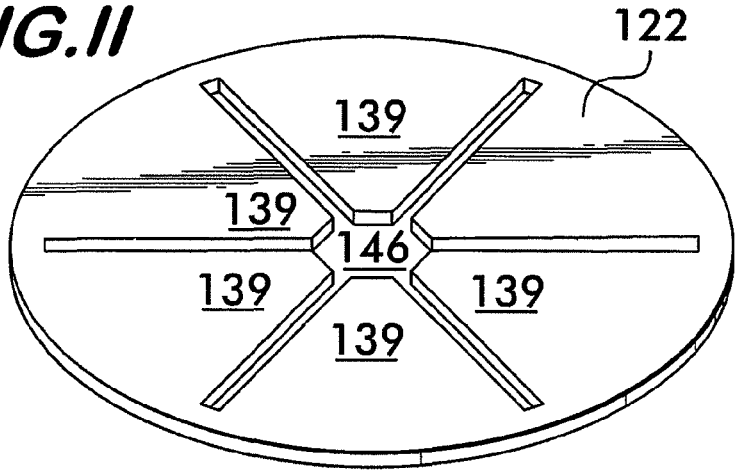

THEFT DETERRENT DEVICE INCLUDING A SPRING WASHER

RELATED APPLICATIONS

This application claims the benefit of U.S. provisional application No. 61/086,952 filed on Aug. 7, 2008.

BACKGROUND OF THE INVENTION

1. Field of the Invention

The current invention relates to an improvement in theft-deterrent devices of the type that includes a pin-clutch mechanism. The current invention is further directed to an improvement in a pin-clutch mechanism of the type in which the pin is released from the clutch mechanism in response to application of a magnetic field.

Theft-deterrent devices are attached to articles, such as merchandise, for deterring the theft of such articles. Theft-deterrent devices of the type that function electronically to produce an alarm if an article to which the device is attached is removed from monitored premises without the device first being removed from the article are known. Typically, the theft-deterrent device includes means for attaching the device to the article with the attaching means being embodied in two components that are adapted to be locked together on opposite sides of a portion of the article to prevent unauthorized removal of the device from the article. A typical attaching means includes a pin and means embodied in the other component for receiving and clutching the pin. The device is attached to the protected article by passing the pin through a portion of the article and into the clutch of the other component.

A disadvantage of such typical theft-deterrent devices is that they often utilize a large and heavy spring within the component for clutching the pin. Use of such a large and heavy spring requires the pin-clutching component of the theft-deterrent device to be unduly large and often bulky which can interfere with a customer's ability to properly examine merchandise for purchase. Also, due to the weight and size of such theft-deterrent devices, use of such devices on finer fabrics or relatively light-weight fabrics is often impractical. A theft-deterrent device which eliminates the use of such a large and heavy spring would eliminate these disadvantages. Another disadvantage of such typical theft-deterrent devices is that they are not intended for one-time use. A one-time use theft-deterrent device may be preferred to more effectively control inventory of such a device prior to and after it is applied to merchandise. Such a one-time use device enables a user to more effectively determine the location, e.g., store location, where the device is applied to merchandise; the time at which the device is applied; and the disposition of the device after it has been removed from the merchandise. A theft-deterrent device that is truly intended for such one-time use such as that described herein, i.e., a device that is rendered inoperable once removed from the merchandise, provides these advantages. The theft-deterrent device of the present invention includes embodiments which overcome the disadvantages set forth above.

2. Description of Related Art

All references cited herein are incorporated herein by reference in their entireties.

BRIEF SUMMARY OF THE INVENTION

A device to protect an article from theft is disclosed. The device includes a pointed pin member to enable attachment of the device to the article to be protected from theft. A housing disposed within the device includes a floor and a wall tapering towards a confining end. The housing includes coaxial openings for insertably receiving the pin member. A ball clutch mechanism is located within the housing and includes a plurality of balls. As the balls are urged towards the confining end of the housing, they wedge between the tapering wall and the pin member to apply increasing radial pressure against the pin member to prevent it from being withdrawn from the device. The floor includes a member which deflects downwardly upon insertion of the pin member into the housing to apply a radial force against the pin member to frictionally engage it within the device.

BRIEF DESCRIPTION OF SEVERAL VIEWS OF THE DRAWINGS

The invention will be described in conjunction with the following drawings in which like reference numerals designate like elements and wherein:

FIG. 9 is an elevational view of the second embodiment of the theft deterrent device of the present invention showing the pin removed from the housing of the theft deterrent device and the magnetic unlocking device applied to the theft deterrent device;

FIG. 10 is an elevational view of the second embodiment of the theft deterrent device of the present invention before insertion of the pin or after removal of the pin; and, FIG. 11 is a perspective view of a washer component of the second embodiment of the theft deterrent device of the present invention.

DETAILED DESCRIPTION OF THE INVENTION

Figure 1:
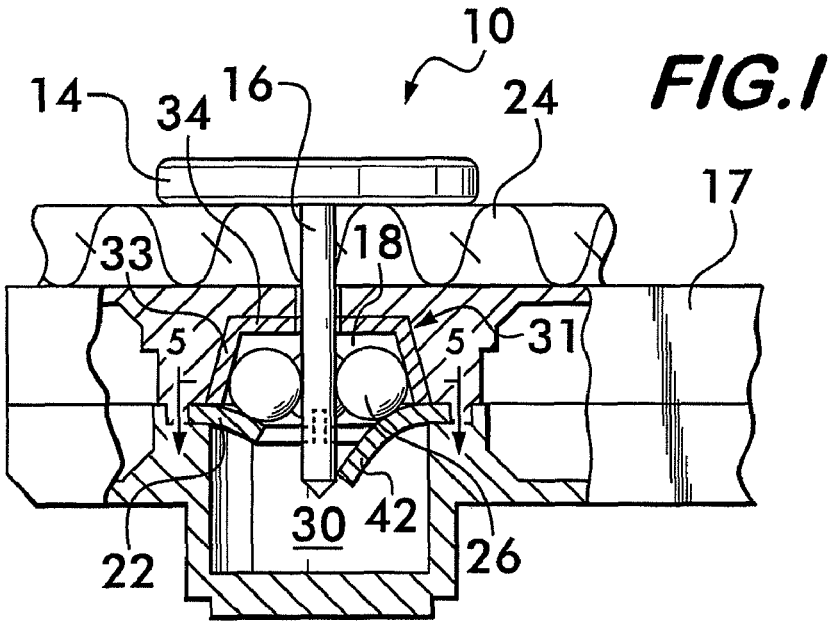
FIG. 1 is an elevational view of a first embodiment of the theft deterrent device of the present invention shown partially in section and shown attached to an article of merchandise.

Referring now to the drawings, a first embodiment of the theft prevention device of the present invention is shown generally at 10 in FIGS. 1 through 6. As will be demonstrated below, this first embodiment is non-reusable. Referring now to FIG. 1, the theft prevention device 10 is basically two components including a pin 14 and a housing 17. The pin 14 includes a shank portion 16. The housing 17, which can be made of any suitable material, e.g., plastic, includes a ball chamber 31. The ball chamber 31 is defined by a wall 33 which is radially symmetric and tapers toward a confining end 34, and a spring washer 22, which opposes the confining end 34. An internal cavity 18 is located within the ball chamber 31. A set of four balls 26 are situated within the cavity 18, and a hopper 30 is located beneath the spring washer 22. It should be understood that fewer or more balls 26 may be employed without departing from the scope of this invention. The balls 26 may be formed of any suitable material and preferably a magnetic material, e.g., steel. As shown in FIG. 1, the pin 14 and housing 17 of the device 10 are adapted to be locked together on opposite sides of a portion of merchandise 24 to prevent unauthorized removal of the device 10 from the merchandise 24.

Figure 2:
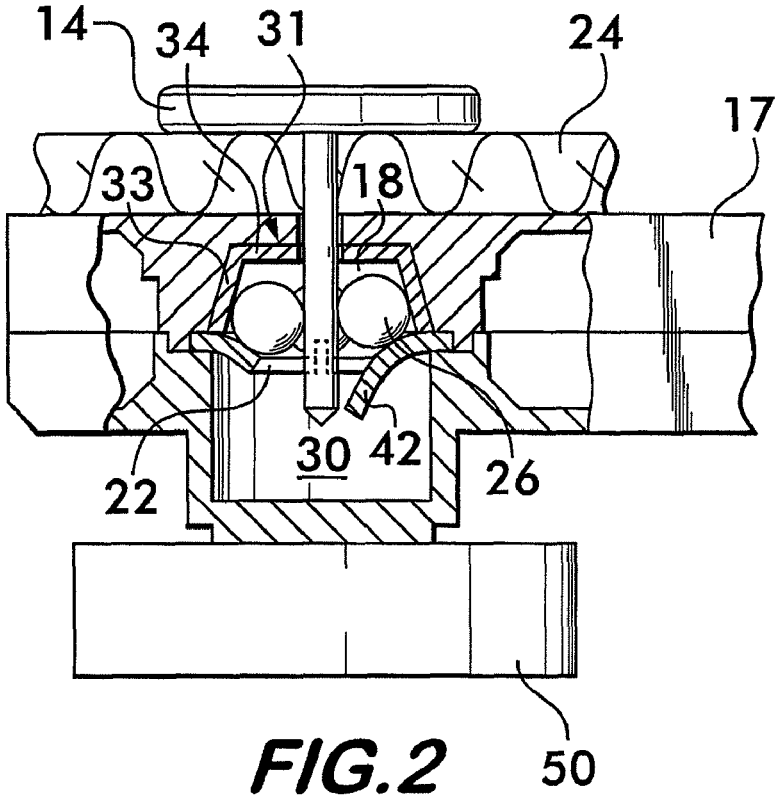
FIG. 2 is an elevational view of the first embodiment of the theft deterrent device of the present invention showing a pin inserted within the housing of the theft deterrent device and a magnetic unlocking device applied to the theft deterrent device.
Figure 3:
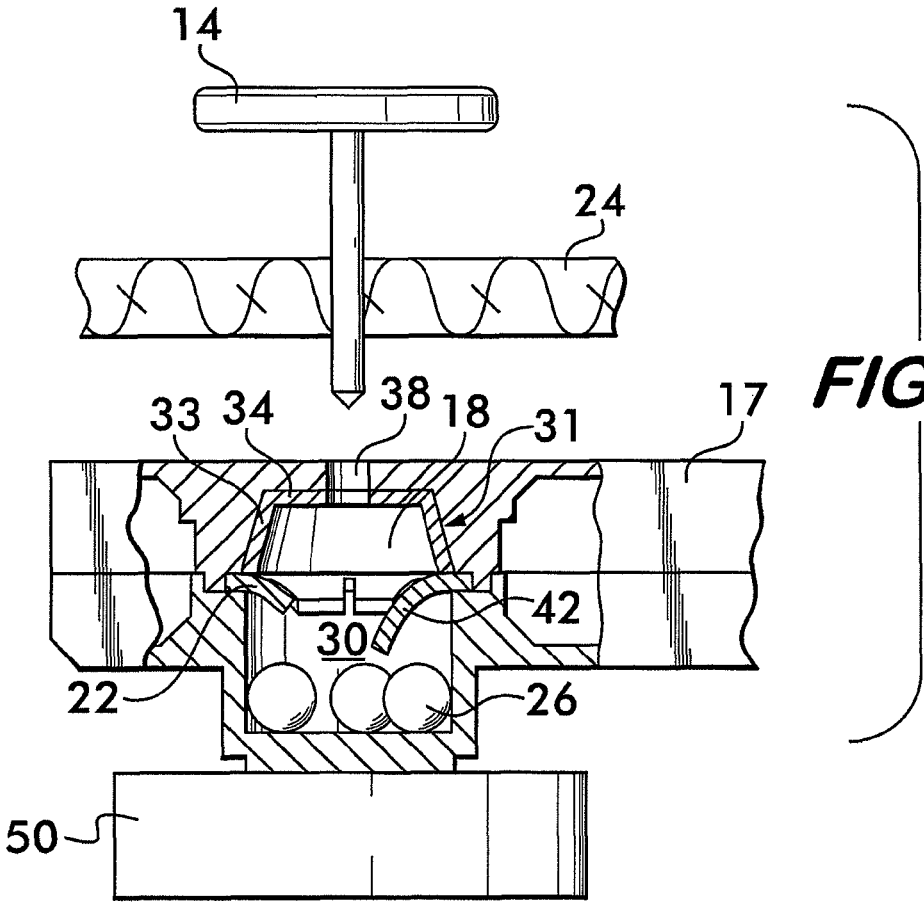
FIG. 3 is an elevational view of the first embodiment of the theft deterrent device of the present invention showing the pin removed from the housing of the theft deterrent device and the magnetic unlocking device applied to the theft deterrent device.
Figure 4:
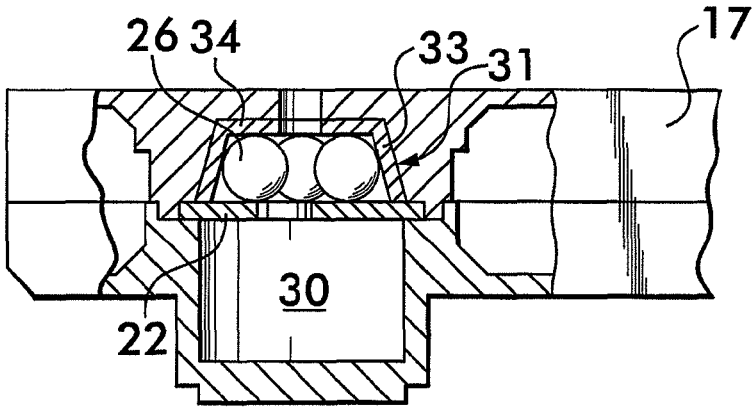
FIG. 4 is an elevational view of the first embodiment of the theft deterrent device of the present invention shown partially in section before insertion of the pin.
Figure 5:
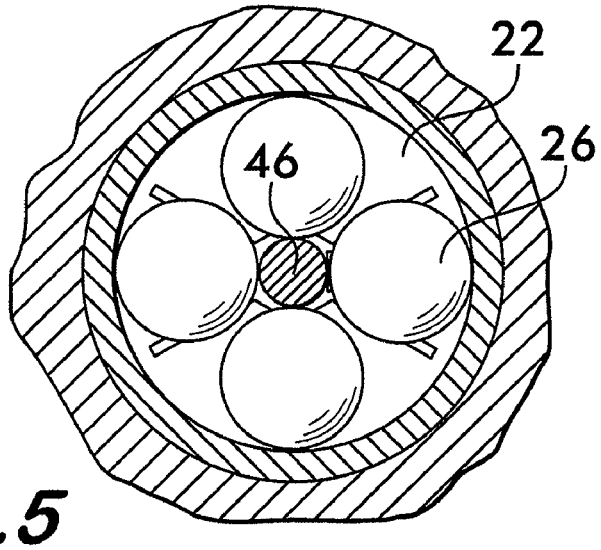
FIG. 5 is a sectional view taken along line 5-5 of FIG. 1.
Figure 6:
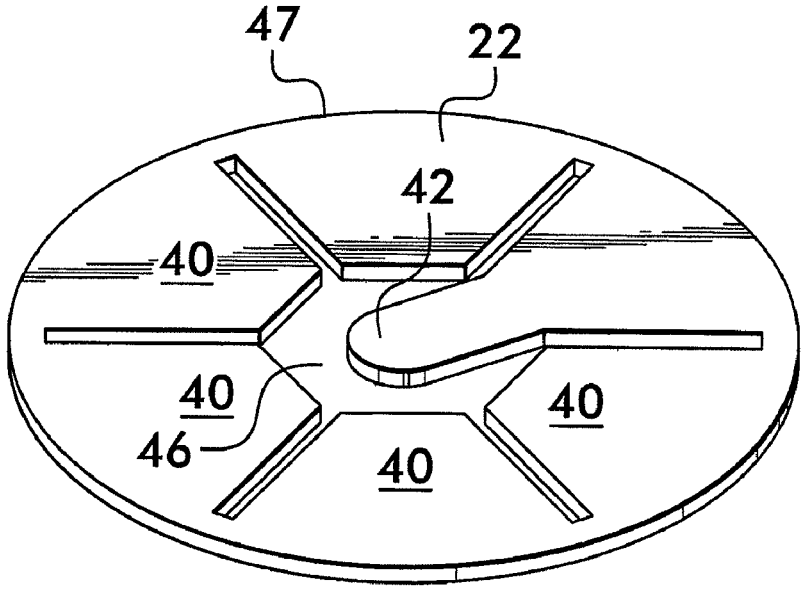
FIG. 6 is a perspective view of a washer component of the first embodiment of the theft deterrent device of the present invention.

The device 10 is attached to the protected merchandise 24 by passing the pin 14 through a portion of the merchandise 24 and through the internal cavity 18. All of the balls 26 are uniformly dimensioned. Together, the wall 33 and the confining end 34 resemble an inverted cup which may be made of any suitable material, e.g., stainless steel. As best shown in FIG. 3, the confining end 34 of the chamber includes a small axial bore 38 for admitting the pin 14 therethrough. The spring washer 22 acts as the floor of the cavity 18. Referring now to FIG. 6, the spring washer 22 includes a centrally located opening 46 which is axially aligned with the bore 38 and includes a plurality of tabs 40 that extend inwardly from its circumference 47 towards the opening 46. As best shown in FIGS. 1, 2 and 4, the tabs 40 may extend slightly beyond the centerline of the balls 26.

As best shown in FIG. 4, prior to insertion of the pin 14 into the cavity 18, the tabs 40 are in an unbended state and urge the balls 26 toward the confining end 34 of the cavity 18. As shown in FIG. 4, prior to insertion of the pin 14, the balls touch the confining end 34. Alternatively, the balls 26 may come in proximity with the confining end 34 prior to insertion of the pin 14. Referring now to FIG. 1, upon insertion of the pin 14 into the cavity 18, the pin 14 extends through the bore 38 and forces the balls 26 along the tapered wall 33 away from the confining end 34 providing clearance between the confining end 34 and the balls 26. As the balls 26 move away from the confining end 34, they exert pressure against the tabs 40 which deflect downwardly and exert an opposite upward pressure forcing the balls 26 toward the confining end 34. In turn, the balls 26 apply radial pressure against the pin 14 to firmly clutch the pin 14 and thereby restrain the pin 14 from removal from the housing 17. The spring washer 22, including the tabs 40, is formed of any suitable magnetic or non-magnetic material so the tabs 40 can be drawn away from the confining end 34.

As best shown in FIG. 6, a deflectable member 42 extends into the central opening 46 of the spring washer 22. In response to insertion of the pin 14 through the opening 46 of the spring washer 22, the deflectable member 42 deflects downwardly and engages the shank portion 16 of the pin 14 to exert a lateral force upon the pin 14 to keep the pin 14 engaged within the housing 17 and to prevent the pin 14 from becoming dislodged from the housing 17 as the result of the device 10 being exposed to a sudden dynamic or impact load, e.g., being dropped on the floor. The deflectable member 42 is formed of any suitable magnetic material which can be attracted by an electromagnet or a permanent magnet so as to draw the deflectable member 42 away from engagement with the pin 14.

Referring now to FIGS. 2 and 3, to remove the pin 14 from the cavity 18, magnetic flux in the form of a permanent magnet, electromagnet, or other magnet 50 is applied. Upon application of a magnetic field axially in relation to the pin 14, the tabs 40 are drawn towards the magnet 50 to enable the balls 26 to move within the cavity 18 away from the confining end 34 to relieve radial pressure applied against the pin 14 to enable removal of the pin 14 from the housing 17. Either the balls 26 or the spring washer 22 may be formed of a magnetic material, e.g., steel. Alternatively, both the balls 26 and the spring washer 22 may be formed of a magnetic material, e.g., steel.

As shown in FIG. 3, upon removal of the pin 14, the balls 26 drop from the cavity 18 and into the hopper 30, thus enabling removal of the pin 14 and preventing reuse of this embodiment 10 of the device. Likewise, the deflectable member 42 bends towards the magnet and disengages from the shank 16 of the pin 14 and further enables the balls 26 to drop into the hopper 30 to enable removal of the pin 14 from the housing 17. Upon removal of the magnet 50 from the device 10, the deflectable member 42 is arranged to remain extending into the hopper 30 and does not elastically return to its original position. The tabs 40 return to the positions they were in prior to insertion of the pin 14 as shown in FIG. 4.

Figure 7:
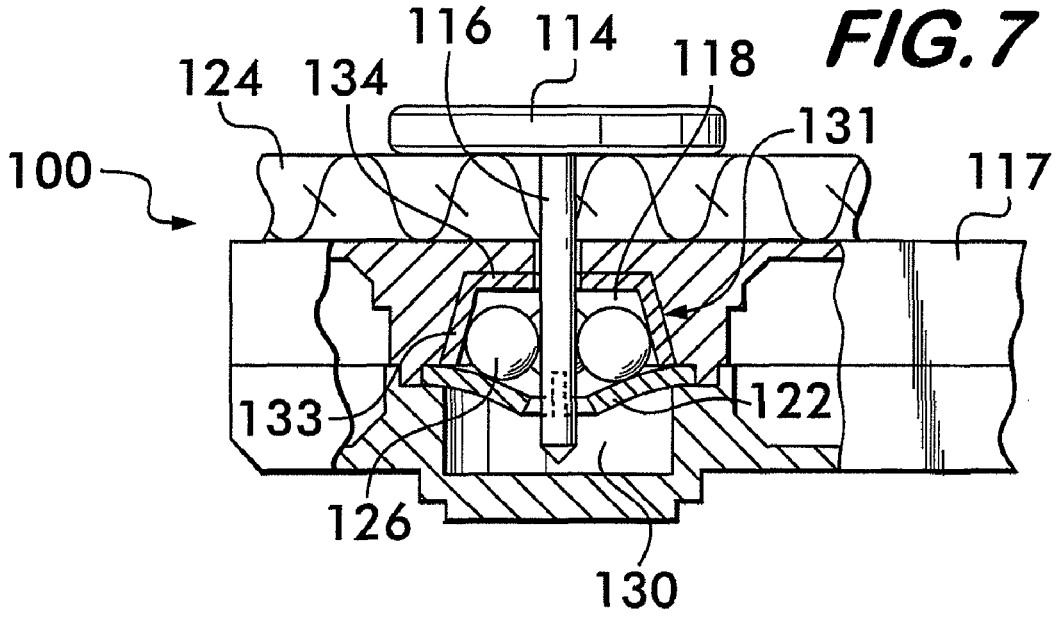
FIG. 7 is an elevational view of a second embodiment of the theft deterrent device of the present invention shown partially in section and shown attached to an article of merchandise.

Referring now to FIGS. 7 through 11, there is shown a second embodiment 100 of the present invention which is multi-use, as opposed to the single use embodiment set forth in FIGS. 1 through 6. As with the first embodiment 10, the second embodiment is basically two components, a pin 114, and a housing 117. The pin 114 includes a shank portion 116, and the housing 117, which can be made of any suitable material, e.g., plastic, includes a ball chamber 131. The ball chamber 131 is defined by a wall 133 which is radially symmetric and tapers toward a confining end 134, and a spring washer 122, which opposes the confining end 134. An internal cavity 118 is located within the ball chamber 131. A set of balls 126 of any suitable number, e.g., four balls, are situated within the cavity 118, and a hopper 130 is located beneath the spring washer 122. As in the first embodiment 10, the balls 126 may be formed of any suitable material and preferably a magnetic material, e.g., steel. As shown in FIG. 7, the pin 114 and housing 117 of the device 100 are adapted to be locked together on opposite sides of a portion of merchandise 124 to prevent unauthorized removal of the device 100 from the merchandise 124.

The device 100 is attached to the protected merchandise 124 by passing the pin 114 through a portion of the merchandise 124 and through the internal cavity 118. All of the balls 126 are uniformly dimensioned. The internal cavity 118 includes a wall 133 which tapers toward a confining end 134 and is radially symmetrical. Together, the wall 133 and the confining end 134 resemble an inverted cup which may be made of any suitable material, e.g., stainless steel. As best shown in FIG. 9, the confining end 134 of the chamber includes a small axial bore 138 for admitting the pin 114 therethrough. The spring washer 122 acts as the floor of the internal cavity 118. Referring now to FIG. 11, the spring washer 122 includes a centrally located opening 146 which is axially aligned with the bore 138 and includes a plurality of tabs 139 that extend inwardly from its circumference towards the opening 146. The opening 146 of the spring washer 122 of the present embodiment 100 is smaller than the opening 46 of the embodiment 10, but larger than the diameter of the pin shank portion 116.

Optionally, one of the plurality of tabs 139 may include a deflectable member (not shown) which extends into the central opening 146 of the spring washer 122 in a manner similar to that described in first embodiment non-reusable device 10 of FIGS. 1-6. The deflectable member (not shown) deflects downwardly upon insertion of the pin 114 through the opening 146 for engaging the shank portion 116 of the pin 114 to exert a lateral force upon the pin 114 to keep the pin 114 engaged with the housing 117 and to prevent the pin 114 from becoming dislodged from the housing 117 as the result of the device 100 being exposed to a sudden dynamic or impact load, e.g., being dropped on the floor.

As best shown in FIG. 10, when the pin 114 is not inserted within the housing 118, the tabs 139 are positioned for urging the balls 126 toward the confining end 134 of the internal cavity 118. Referring now to FIG. 7, upon insertion of the pin 114 into the internal cavity 118, the pin 114 extends through the bore 138 forcing the balls 126 along the tapered wall 133 away from the confining end 134. In response, the tabs 139 (and optionally the deflectable member, not shown) deflect downwardly and exert an opposite upward pressure forcing the balls 126 toward the confining end 134. In turn, the balls 126 apply radial pressure against the pin 114 to firmly clutch the pin 114 and thereby restrain the pin 114 from removal from the housing 117. The tabs 139 are formed of any suitable magnetic material so they can be drawn away from the confining end 134.

Figure 8:
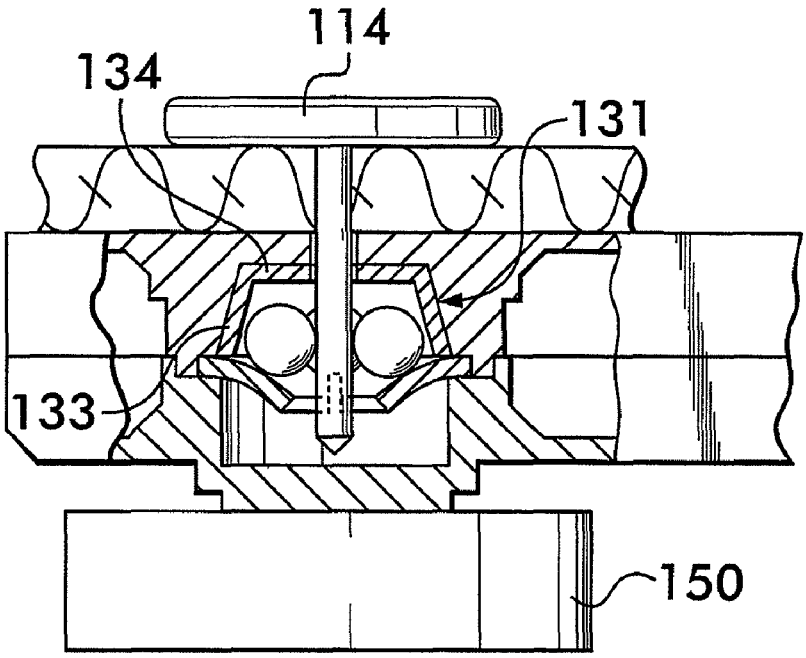
FIG. 8 is an elevational view of the second embodiment of the theft deterrent device of the present invention showing a pin inserted within the housing of the theft deterrent device and a magnetic unlocking device applied to the theft deterrent device.

Referring now to FIGS. 8 and 9, in order to remove the pin 114 from the internal cavity 118, magnetic flux in the form of a permanent magnet or electromagnet 150 is applied. Upon application of a magnetic field axially in relation to the pin 114, the tabs 139 (and optionally, the deflectable member, not shown) are drawn towards the magnet 150 to enable the balls 126 to move within the internal cavity 118 away from the confining end 134 to relieve radial pressure applied against the pin 114 by the balls 126 to enable removal of the pin 114 from the housing 117. The tabs 139 of this embodiment 100 are slightly longer than the tabs 40 of the embodiment 10. As shown in FIG. 9, upon removal of the pin 114, the balls 126 remain within the internal cavity 118 and do not fall into the hopper 130, as a result of the smaller size of the opening 146 of the spring washer 122 of this embodiment 100, thus enabling reuse of this embodiment of the device 100. As shown in FIG. 10, after the magnet 150 has been removed, the tabs 139 return to the position they were in prior to insertion of the pin 114.

What is claimed is:

1. A theft protection device comprising:

a. a pin member for attaching said device to an article to be protected from theft;

b. a housing disposed within said device, said housing including a floor and a wall tapering towards a confining end;

c. a ball clutch mechanism disposed within said housing, said ball clutch mechanism applying radial pressure against said pin member to prevent said pin member from being removed from said device;

d. coaxial openings extending through said housing and said ball clutch mechanism for insertably receiving said pin member in a longitudinal direction; and, e. said floor comprising a deflectable member which deflects in a direction away from the confining end of the housing upon insertion of said pin member to apply a radial force against said pin member to frictionally engage said pin member within said device.

2. The theft protection device of claim 1, wherein said ball clutch mechanism comprises a plurality of balls.

3. The theft protection device of claim 2, additionally comprising a magnetic unlocking device for applying a magnetic force along said vertical direction to release said plurality of balls from said pin member whereby said pin member may be released and removed from said theft protection device.

4. The theft protection device of claim 3, wherein said floor includes a plurality of radially extending bendable tabs formed of a magnetic material, wherein in response to said magnetic force, said tabs bend in a direction away from said confining end of said housing to release said plurality of balls from said pin member.

5. The theft protection device of claim 1, wherein the pin member includes a diameter and wherein said opening within said ball clutch mechanism is less than said diameter.

6. The theft protection device of claim 2, wherein said balls are formed of a material attracted to magnetic force.

7. The theft protection device of claim 2, wherein said balls are formed of a non-magnetic material.

8. The theft protection device of claim 2, wherein said balls are uniformly dimensioned.

9. The theft protection device of claim 2, wherein said ball clutch mechanism includes four balls.

10. The theft protection device of claim 1, wherein said ball clutch mechanism includes three balls.

11. The theft protection device of claim 9, wherein said four balls are uniformly dimensioned.

12. The theft protection device of claim 1, wherein said pin member comprises an expansive head and an elongated shank attached to said expansive head and being pointed at one end for enabling attachment to an article to be protected from theft by inserting the pointed end of the elongated shank through the article and into the coaxial openings of said housing and said ball clutch.

13. The theft protection device of claim 1, wherein said housing comprises a cup-like structure having a hollow interior.

14. The theft protection device of claim 2, wherein in response to an attempt to remove said pin member from said device, said plurality of balls are forced towards the confining end of the cup and are wedged between the tapering wall and said pin member to apply radial pressure against said pin member to prevent its removal from said device.

15. The theft protection device of claim 3, wherein upon release and removal of said pin member from said theft protection device, said plurality of balls remain disposed within said housing.

16. The theft protection device of claim 15, wherein said device is reusable.

17. The theft protection device of claim 3 additionally comprising a hopper located adjacent to said housing, wherein said floor additionally comprises an enlarged aperture, and upon release and removal of said pin member from said theft protection device, at least one of said plurality of balls falls through said opening and into said hopper.

18. The theft protection device of claim 17, wherein said device is not reusable.

19. The theft protection device of claim 17, wherein said enlarged aperture is centrally-located and said deflectable member extends into said aperture.

20. A theft protection device comprising:

a. a pin member for attaching said device to an article to be protected from theft;

b. a housing disposed within said device, said housing including a floor and a wall tapering towards a confining end;

c. a ball clutch mechanism disposed within said housing, said ball clutch mechanism comprising a plurality of balls applying radial pressure against said pin member to prevent said pin member from being removed from said device;

d. coaxial openings extending through said housing and said ball clutch mechanism for insertably receiving said pin member in a longitudinal direction; and, e. said floor comprising a plurality of radially extending bendable tabs formed of a magnetic material, wherein in response to a magnetic force, said tabs bend in a direction away from said confining end of said housing to release said plurality of balls from said pin member.

* * * * *

UNITED STATES PATENT AND TRADEMARK OFFICE

CERTIFICATE OF CORRECTION

PATENT NO. : 8,117,874 B2
APPLICATION NO. : 12/509722
DATED : February 21, 2012
INVENTOR(S) : McKeown et al.

It is certified that error appears in the above-identified patent and that said Letters Patent is hereby corrected as shown below:

In the Claims:

In column 5, line 67, replace the word "vertical" with the word --longitudinal-- in Claim 3.

In column 6, line 37, replace the word "cup" with the word --housing-- in Claim 14.

Signed and Sealed this
Third Day of September, 2013

Teresa Stanek Rea
*Acting Director of the United States Patent and Trademark Office*